US008920219B2

(12) United States Patent
Allison et al.

(10) Patent No.: US 8,920,219 B2
(45) Date of Patent: Dec. 30, 2014

(54) POLISHING PAD WITH ALIGNMENT APERTURE

(75) Inventors: William C. Allison, Beaverton, OR (US); Diane Scott, Portland, OR (US); Rajeev Bajaj, Fremont, CA (US)

(73) Assignee: NexPlanar Corporation, Hillsboro, OR (US)

( * ) Notice: Subject to any disclaimer, the term of this patent is extended or adjusted under 35 U.S.C. 154(b) by 642 days.

(21) Appl. No.: 13/184,395

(22) Filed: Jul. 15, 2011

(65) Prior Publication Data

US 2013/0017764 A1 Jan. 17, 2013

(51) Int. Cl.

| | |
|---|---|
| ***B24B 11/00*** | (2006.01) |
| ***B24B 37/20*** | (2012.01) |
| ***B24B 37/22*** | (2012.01) |
| ***B24B 37/26*** | (2012.01) |

(52) U.S. Cl.

CPC ..... *B24B 37/205* (2013.01); *B24B 37/22* (2013.01); *B24B 37/26* (2013.01)

USPC ..... 451/527; 451/529; 451/533; 451/550; 451/551

(58) Field of Classification Search

CPC ..... B24B 37/16; B24B 37/24; B24B 37/205; B24B 37/22; B24B 37/26; B24D 7/12; B24D 3/001; B24D 3/20; B24D 3/28; B24D 3/32; B24D 11/02

USPC ..... 51/297, 298, 296; 451/527, 529, 530, 451/533, 550, 551

See application file for complete search history.

(56) References Cited

U.S. PATENT DOCUMENTS

| | | | | |
|---|---|---|---|---|
| 7,081,044 | B2 * | 7/2006 | Ohta et al. | 451/59 |
| 7,182,670 | B2 * | 2/2007 | Muldowney | 451/6 |
| 7,547,243 | B2 * | 6/2009 | Wiswesser et al. | 451/6 |
| 7,874,894 | B2 * | 1/2011 | Fukuda et al. | 451/6 |
| 8,083,570 | B2 * | 12/2011 | String et al. | 451/6 |
| 8,475,228 | B2 * | 7/2013 | Benvegnu et al. | 451/6 |
| 8,662,957 | B2 * | 3/2014 | Paik et al. | 451/6 |
| 2004/0224611 | A1 * | 11/2004 | Aoi et al. | 451/6 |
| 2005/0060943 | A1 * | 3/2005 | Turner et al. | 51/297 |
| 2005/0197050 | A1 | 9/2005 | Prasad et al. | |
| 2007/0161342 | A1 * | 7/2007 | Shirakashi et al. | 451/296 |
| 2009/0311955 | A1 | 12/2009 | Kerprich et al. | |
| 2010/0267318 | A1 * | 10/2010 | Duboust et al. | 451/533 |
| 2011/0171883 | A1 * | 7/2011 | Allison et al. | 451/6 |

FOREIGN PATENT DOCUMENTS

| | | | | |
|---|---|---|---|---|
| JP | 2002001652 | A * | 1/2002 | B24B 37/04 |

OTHER PUBLICATIONS

International Preliminary Report on Patentability dated Jan. 21, 2014, in International Patent Application No. PCT/US2012/046037, 11 pgs.

International Search Report and Written Opinion from PCT/US2012/046037 mailed Mar. 13, 2013, 17 pgs.

* cited by examiner

*Primary Examiner* — Timothy V Eley

(74) *Attorney, Agent, or Firm* — Blakely Sokoloff Taylor Zafman LLP

(57) ABSTRACT

Polishing pads with apertures are described. Methods of fabricating polishing pads with apertures are also described.

17 Claims, 11 Drawing Sheets

POLISHING PAD WITH ALIGNMENT APERTURE

TECHNICAL FIELD

Embodiments of the present invention are in the field of chemical mechanical polishing (CMP) and, in particular, polishing pads with apertures.

BACKGROUND

Chemical-mechanical planarization or chemical-mechanical polishing, commonly abbreviated CMP, is a technique used in semiconductor fabrication for planarizing a semiconductor wafer or other substrate.

The process uses an abrasive and corrosive chemical slurry (commonly a colloid) in conjunction with a polishing pad and retaining ring, typically of a greater diameter than the wafer. The polishing pad and wafer are pressed together by a dynamic polishing head and held in place by a plastic retaining ring. The dynamic polishing head is rotated during polishing. This approach aids in removal of material and tends to even out any irregular topography, making the wafer flat or planar. This may be necessary in order to set up the wafer for the formation of additional circuit elements. For example, this might be necessary in order to bring the entire surface within the depth of field of a photolithography system, or to selectively remove material based on its position. Typical depth-of-field requirements are down to Angstrom levels for the latest sub-50 nanometer technology nodes.

The process of material removal is not simply that of abrasive scraping, like sandpaper on wood. The chemicals in the slurry also react with and/or weaken the material to be removed. The abrasive accelerates this weakening process and the polishing pad helps to wipe the reacted materials from the surface. In addition to advances in slurry technology, the polishing pad plays a significant role in increasingly complex CMP operations.

However, additional improvements are needed in the evolution of CMP pad technology.

SUMMARY

Embodiments of the present invention include polishing pads with apertures.

In an embodiment, a polishing apparatus for polishing a substrate includes a polishing pad having a polishing surface and a back surface. The polishing surface includes a pattern of grooves. An aperture is disposed in the polishing pad from the back surface through to the polishing surface. An adhesive sheet is disposed on the back surface of the polishing pad but not in the aperture. The adhesive sheet provides an impermeable seal for the aperture at the back surface of the polishing pad.

In another embodiment, a polishing pad for polishing a substrate includes a polishing body having a polishing surface and a back surface. The polishing surface includes a pattern of grooves. An aperture is disposed in the polishing body from the back surface through to the polishing surface. The aperture has a sidewall having a ramp feature with a slope to provide a narrowest region of the aperture at the back surface of the polishing body and a widest region of the aperture at the polishing surface of the polishing body.

In another embodiment, a polishing pad for polishing a substrate includes a polishing body having a polishing surface and a back surface. The polishing surface includes a pattern of grooves. An aperture is disposed in the polishing body from the back surface through to the polishing surface. A first groove of the pattern of grooves is a circumferential groove continuous with the aperture at a first sidewall of the aperture but discontinuous with a second sidewall of the aperture. A second groove of the pattern of grooves is continuous with the aperture at the second sidewall.

In another embodiment, a polishing pad for polishing a substrate includes a polishing body having a polishing surface and a back surface. The polishing surface includes a pattern of grooves. An aperture is disposed in the polishing body from the back surface through to the polishing surface. A first groove of the pattern of grooves is a first radial groove continuous with the aperture at a first sidewall of the aperture. A second groove of the plurality of grooves is a second radial groove continuous with the aperture at a second sidewall of the aperture. The first sidewall is opposite the second sidewall.

In another embodiment, a method of polishing a substrate includes disposing a polishing pad above a platen of a chemical mechanical polishing apparatus. The polishing pad has a polishing surface, a back surface, and an aperture disposed in the polishing pad from the back surface through to the polishing surface. The polishing surface includes a pattern of grooves. A chemical mechanical polishing slurry is dispensed on the polishing surface of the polishing pad. A substrate is polished with the chemical mechanical polishing slurry at the polishing surface of the polishing pad. Through the aperture, the polishing of the substrate is monitored with an optical monitoring device coupled with the platen.

In another embodiment, a method of fabricating a polishing pad for polishing a substrate includes mixing a set of polymerizable materials to form a mixture in a base of a formation mold. A lid of the formation mold and the mixture together are moved together. The lid has disposed thereon a pattern of protrusions and an aperture protrusion with a height greater than the pattern of protrusions. With the lid placed in the mixture, the mixture is at least partially cured to form a molded homogeneous polishing body having a back surface. The molded homogeneous polishing body also has a polishing surface having disposed therein a pattern of grooves and an opening defining an aperture region.

DETAILED DESCRIPTION

Figure 1:
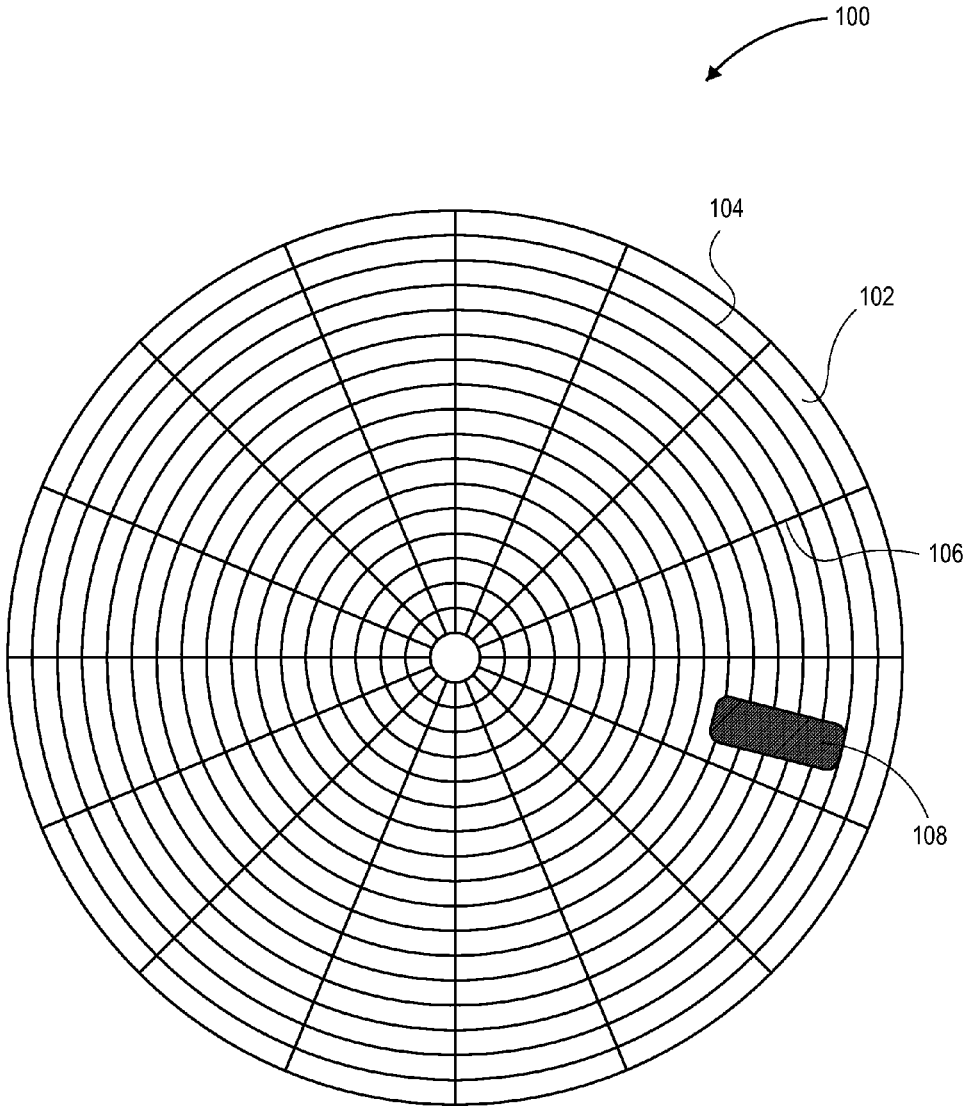
FIG. 1 illustrates a top-down plan view of a polishing pad having a window disposed therein.

Polishing pads with apertures are described herein. In the following description, numerous specific details are set forth, such as specific polishing pad compositions and designs, in order to provide a thorough understanding of embodiments of the present invention. It will be apparent to one skilled in the art that embodiments of the present invention may be practiced without these specific details. In other instances, well-known processing techniques, such as details concerning the delivery of a slurry to a polishing pad to perform CMP of a substrate, are not described in detail in order to not unnecessarily obscure embodiments of the present invention. Furthermore, it is to be understood that the various embodiments shown in the figures are illustrative representations and are not necessarily drawn to scale.

Features may need to be introduced to polishing pads for advanced chemical mechanical polishing processing. For example, otherwise opaque polishing pads may have one or more "windows" included therein to allow a substantial transmission of visible light for various monitoring applications. One such monitoring application may involve use of an optical device mounted within or on a chemical mechanical polishing apparatus. The optical device is used to monitor a chemical mechanical polishing process by, e.g., reflectance changes in the substrate undergoing polishing. The process is monitored through the window of the polishing pad since the polishing occurs at a top polishing surface of the polishing pad. The window is typically formed by inserting a transparent plug into the pad or by molding a transparent region (e.g., a local area transparency region or LAT) into an otherwise opaque pad at the time of fabrication. In either case, the window is composed of a distinct material included in the pad.

In accordance with an embodiment of the present invention, a "windowless" polishing pad suitable for optical monitoring there through is provided. As an example, an aperture is provided in the polishing pad allowing for optical monitoring through the polishing pad. In one embodiment, the aperture is an opening or hole made in the pad that extends through the entire pad. Thus, in contrast to a pad including a window composed of a material, the windowless polishing pad is characterized by the absence of material.

Conventionally, a mere hole formed in a polishing pad would have been unsuitable for monitoring a chemical mechanical process. For example, slurry would have been able to escape through the pad, possibly eroding an underlying optical monitoring device. In another example, a hole that fills with an opaque slurry may be unsuitable for allowing sufficient light transmission for optical detection. However, advanced slurries now being tested or in use are relatively, if not entirely, transparent.

As such, in an embodiment of the present invention, filling of an aperture with a slurry does not detrimentally impact optical detection. Furthermore, in an embodiment, a clear sheet (e.g., a pressure sensitive adhesive or PSA) is included between a polishing pad with an aperture there through and a chemical mechanical polishing apparatus. In one such embodiment, the clear sheet provides a seal under the pad to protect the platen and, e.g., a quartz laser site. As described in more detail below, various aperture designs are provided. In some embodiments, the designs include provisions to keep a slurry flushing across the opening or aperture during a polishing process. In a specific such embodiment, an aperture designed for slurry flushing is used to prevent polishing debris from collecting, agglomerating, and potentially attenuating the laser or other optical signal.

Conventional "window" polishing pads typically have an insert or LAT region of a material suitably transparent included therein. For example, FIG. 1 illustrates a top-down plan view of a polishing pad having a window disposed therein.

Referring to FIG. 1, a polishing pad 100 includes a polishing body having a polishing surface 102 and a back surface (not shown). The polishing surface 102 has a pattern of concentric circumferential grooves 104. The pattern of grooves also includes a plurality of radial grooves 106 continuous from the inner most circumferential groove to the outer most circumferential groove. A window 108 is included in the polishing pad 100 and is visible from the polishing surface 102. The window is composed of a suitably transparent material such as a plug (or insert) or an LAT region, as described above. It is noted that, although not necessarily always the case, conventional polishing pads typically have concentric circular groove patterns, as depicted in FIG. 1.

In an aspect of the present invention, a windowless polishing pad suitable for optical monitoring includes an aperture there through. For example, FIGS. 2A and 2B illustrate a top-down plan view and a cross-sectional view, respectively, of a polishing apparatus including a polishing pad with an aperture there through, in accordance with an embodiment of the present invention.

Figure 2A:
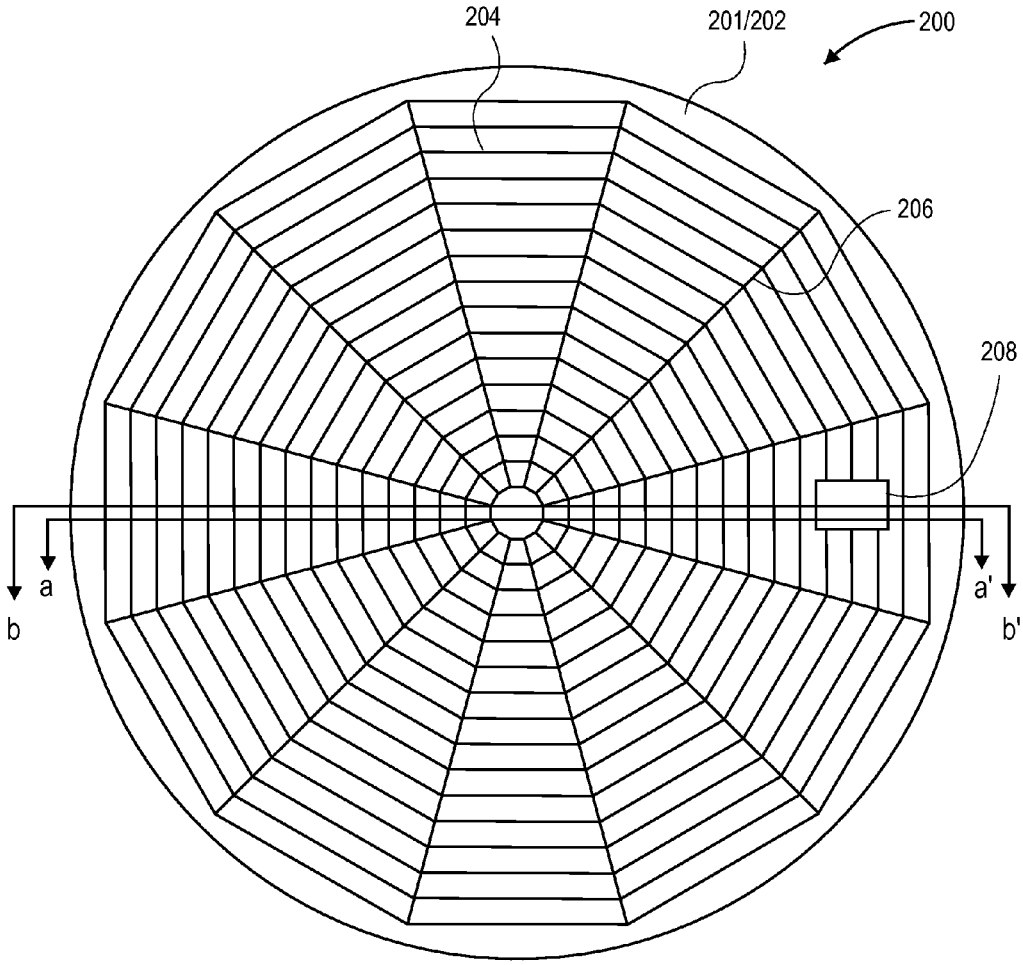
FIG. 2A illustrates a top-down plan view of a polishing apparatus including a polishing pad with an aperture there through, in accordance with an embodiment of the present invention.
Figure 2B:
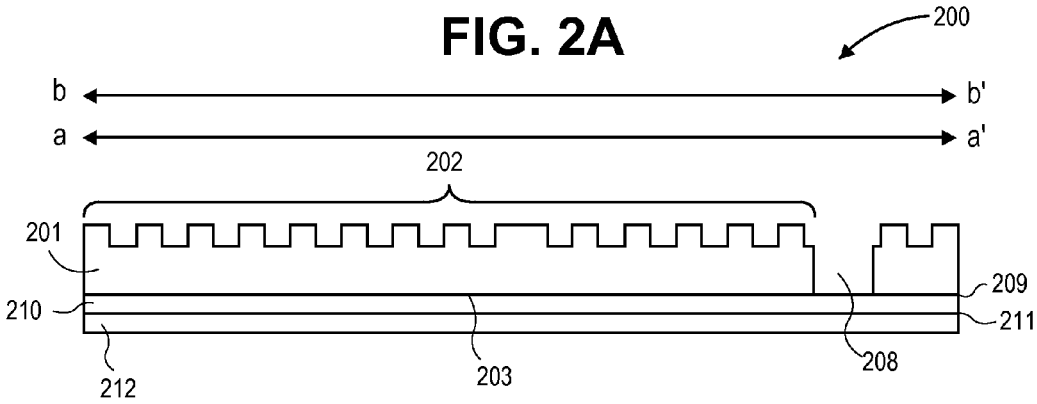
FIG. 2B illustrates a cross-sectional view of the polishing apparatus of FIG. 2A, in accordance with an embodiment of the present invention.

Referring to FIGS. 2A and 2B, a polishing apparatus 200 for polishing a substrate includes a polishing pad 201. The polishing pad 201 has a polishing surface 202 and a back surface 203. The polishing surface includes a pattern of grooves, such as circumferential groove 204 and radial groove 206. An aperture 208 is disposed in the polishing pad 201 from the back surface 203 through to the polishing surface 202. In an embodiment, the aperture 208 includes no material between the back surface 203 and the polishing surface 202, e.g., there is no plug, insert or LAT region in the location of aperture 208, as depicted in FIG. 2B.

Referring to FIG. 2B, the polishing apparatus 200 also includes an adhesive sheet 210 disposed on the back surface 203 of the polishing pad 201 but not in the aperture 208. In an embodiment, the adhesive sheet 210 provides an impermeable seal for the aperture 208 at the back surface 203 of the polishing pad 201. However, in an embodiment, the adhesive sheet 210 is not considered to be a part of the polishing pad 201. For example, adhesive sheet 210 is not a part of nor contributes substantially to the polishing characteristics of the polishing surface 202. The adhesive sheet 210 is not similar in properties or characteristics to the bulk of the polishing pad 201. In one embodiment, since the adhesive sheet 210 does not measurably or significantly contribute to the polishing characteristics of the polishing apparatus 200, the adhesive sheet 210 cannot be considered as a "sub-pad," "base-pad," "first pad layer," or similar descriptors.

In an embodiment, the adhesive sheet 210 includes an adhesive layer to bond a sheet portion to the polishing pad 203. For example, in one embodiment, a layer of acrylic glue (shown as interface 209) is disposed on the back surface 203 of the polishing pad 201 and a layer of polyethylene terephthalate (PET) (shown as 210 in this embodiment) disposed on the layer of acrylic glue 209. In a specific such embodiment, the adhesive sheet 210 further includes a layer of rubber glue (shown as interface 211) disposed on the layer of PET 210, opposite the first layer of acrylic glue 209. In an embodiment, a disposable layer 212, such as a 3 mils layer of PET, is used to protect the layer of rubber glue 211 until the polishing apparatus 200 is used, at which point the disposable layer 212 is removed.

In an embodiment, the layer of rubber glue 211 is for adhering the polishing pad 203 to a platen of a chemical mechanical polishing tool. In an embodiment, the adhesive sheet 210 is sufficiently transparent for performing optical monitoring through the adhesive sheet 210, which may include acrylic glue layer 209 and rubber glue layer 211, and the aperture 208. In one such embodiment, the adhesive sheet 210 is for protecting a quartz laser site of an optical monitoring device coupled with a platen of a chemical mechanical polishing tool. In an embodiment, the adhesive sheet 210 which may include one or more adhesive layers is used to form an impermeable seal (e.g., impermeable to slurry) between the polishing pad 203 and a platen, particularly at or near the location of aperture 208.

It is to be understood that an aperture may be included in a polishing pad having a polishing surface with any pattern of grooves suitable for a chemical mechanical polishing process. For example, referring to FIG. 2A, the polishing surface 202 has a pattern of grooves of concentric polygons (as opposed to concentric circles as shown in FIG. 1) with radial grooves. That is, the circumferential grooves 204 form concentric polygons with radial groove 206 running through the vertexes thereof. For example, in a specific embodiment, the pattern of grooves of concentric polygons is a pattern of grooves of concentric dodecagons, as depicted in FIG. 2A.

Basic examples of possible embodiments contemplated for groove patterns having concentric polygons as circumferential grooves, include groove patterns based on a series of grooves that form similar polygons, all with the same center point, and all aligned with an angle theta of zero so that their straight line segments are parallel and their angles are aligned in a radial fashion. Nested triangles, squares, pentagons, hexagons, etc., are all considered within the spirit and scope of the present invention. There may be a maximum number of straight line segments above which the polygons will become approximately circular. Preferred embodiments may include limiting the groove pattern to polygons with a number of sides less than such a number of straight line segments. One reason for this approach may be to improve averaging of the polish benefit, which might otherwise be diminished as the number of sides of each polygon increases and approaches a circular shape. Another embodiment includes groove patterns with concentric polygons having a center that is not in the same location as the polishing pad center. Of course, in other embodiments, an aperture may be formed in a pad with circular circumferential grooves.

Referring again to FIG. 2A, and in accordance with an embodiment of the present invention, the shape of the aperture 208, particularly as viewed from the polishing surface 202, is suitable to allow flushing of slurry from the aperture during a chemical mechanical polishing operation. Examples of aperture designs which may be suitable are described in detail below in association with FIGS. 3-7.

Figure 3:
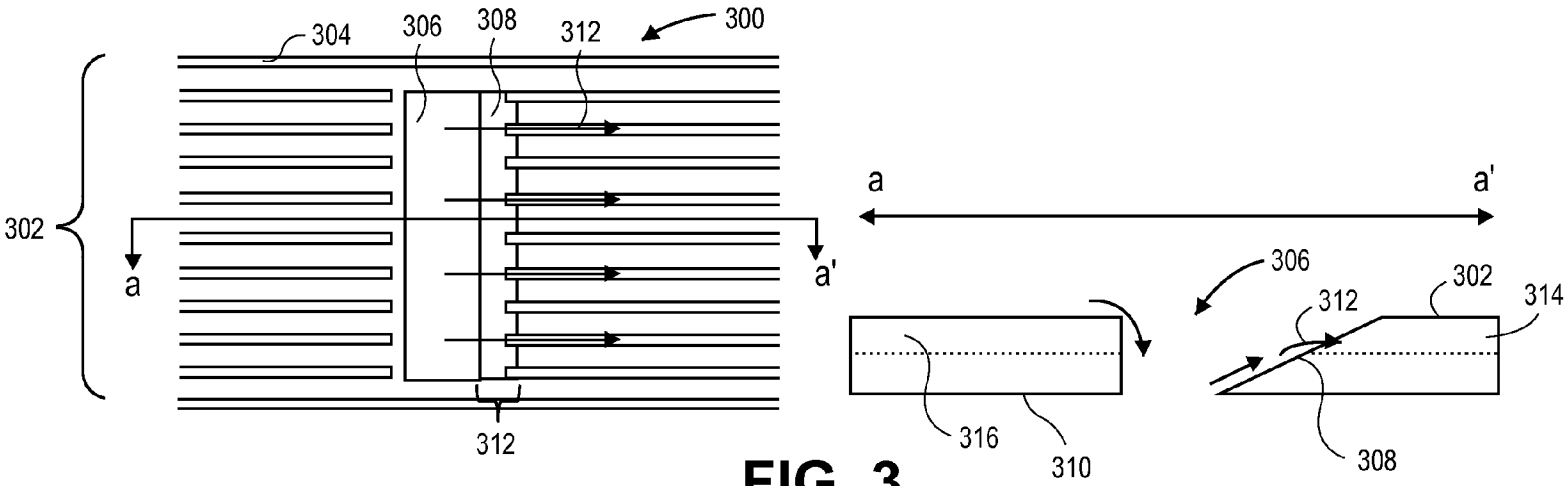
FIG. 3 illustrates a top-down plan view and a cross-sectional view of a portion of a polishing surface of a polishing pad with an aperture having a ramp, in accordance with an embodiment of the present invention.
Figure 4:
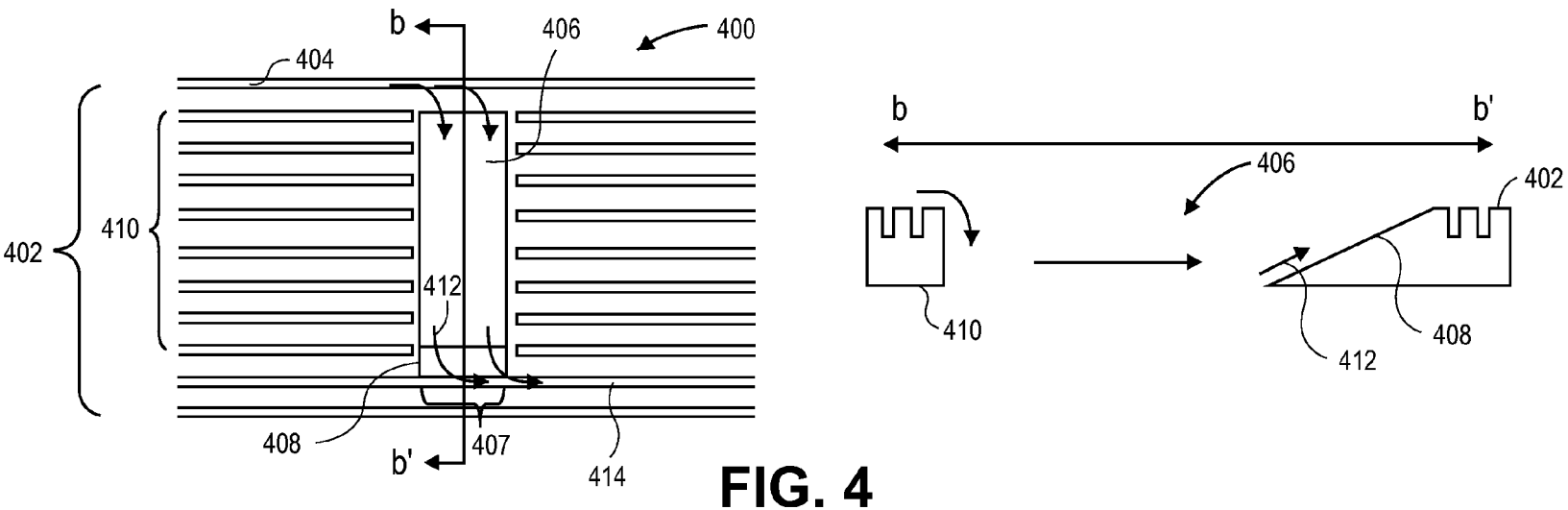
FIG. 4 illustrates a top-down plan view and a cross-sectional view of a portion of a polishing surface of a polishing pad with an aperture having a ramp, in accordance with another embodiment of the present invention.

In a first such example, FIGS. 3 and 4 both illustrate top-down plan views and cross-sectional views of a portion of a polishing surface of a polishing pad with an aperture having a ramp, in accordance with an embodiment of the present invention. A wedge or ramp shape of one or more edges of the opening may facilitate slurry flow out of the opening of the aperture. A ramp may be included at a downstream side of the opening or at an outward end of the opening.

Referring to both FIGS. 3 and 4, a portion of a polishing pad 300 or 400 includes a polishing body having a polishing surface 302 or 402, respectively, and a back surface (not shown). The polishing surface 302 or 402 includes a pattern of grooves 304 or 404, respectively. An aperture 306 or 406, respectively, is disposed in the polishing body from the back surface through to the polishing surface 302 or 402. The aperture 306 or 406 includes a sidewall 307 or 407 having a ramp feature 308 or 408, respectively. Referring to FIG. 3, in one embodiment, one or more grooves 310 of the plurality of grooves 304 is interrupted by the aperture 306 and is parallel with the slope of the ramp feature 308. Referring to FIG. 4, in another embodiment, one or more grooves of the plurality of grooves 410 is interrupted by the aperture 406 and is orthogonal with the slope of the ramp feature 408.

Referring to both FIGS. 3 and 4, and as best viewed along the a-a' and b-b' axes, respectively, in an embodiment, the slope of the ramp feature 308 or 408 provides a narrowest region of the aperture 306 or 406 at the back surface 310 or 410 of the polishing body and a widest region of the aperture 306 or 406 at the polishing surface 302 or 402 of the polishing body. In an embodiment, the ramp features 308 or 408 facilitate the flow of slurry out of aperture 306 or 406, respectively. For example, referring to FIG. 3, slurry that migrates into aperture 306 is removed along the direction of arrows 312 along grooves with ends that are continuous with (e.g., have openings into) the aperture 306. The position of one such groove 314 is depicted by the dashed line shown in the view taken along the a-a' axis. The corresponding grooves that enter the aperture 308 may be discontinuous with or continuous with (the latter depicted for groove 316 by the dashed line shown in the view taken along the a-a' axis). In another example, referring to FIG. 4, slurry that migrates into aperture 406 is removed along the direction of arrows 412 along a groove 414 with a sidewall that is continuous with (e.g., has an opening into) the aperture 406.

Figure 5:
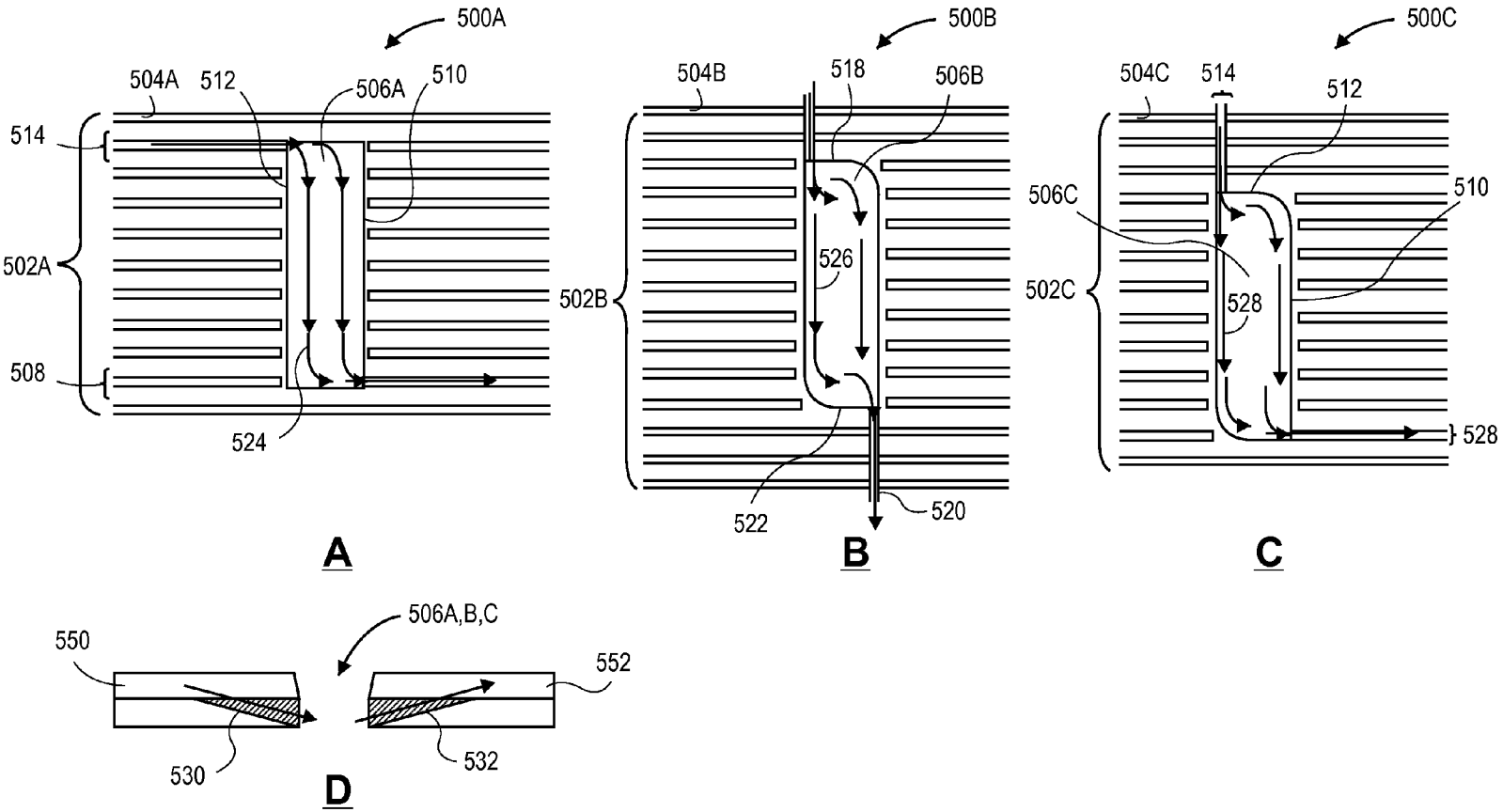
FIG. 5 illustrates top-down plan views (A, B, C) and a cross-sectional view (D) of portions of polishing surfaces of polishing pads with an aperture continuous with one or more grooves of the polishing surface, in accordance with an embodiment of the present invention.

In a second such example, FIG. 5 illustrates top-down plan views (A, B, C) and a cross-sectional view (D) of portions of polishing surfaces of polishing pads with an aperture continuous with one or more grooves of the polishing surface, in accordance with an embodiment of the present invention. One or more grooves connected or continuous with the opening of an aperture, such as radial grooves, circumferential grooves, or a combination thereof, may be used to accommodate slurry flow across the opening of the aperture. The groove depth may be approximately equal to the opening depth where they are continuous, with the groove floor ramping up to normal groove depth.

Referring to FIGS. 5A, 5B, and 5C, a portion of a polishing pad 500A, 500B, or 500C includes a polishing body having a polishing surface 502A, 502B, or 502C, respectively, and a back surface (not shown). The polishing surface 502A, 502B, or 502C includes a pattern of grooves 504A, 504B, or 504C, respectively. An aperture 506A, or 506B, or 506C, respectively, is disposed in the polishing body from the back surface through to the polishing surface 502A, 502B, or 502C.

Referring to FIGS. 5A and 5C, a first groove 508 of the pattern of grooves 504A or 504C is a circumferential groove continuous with the aperture 506A or 506C at a first sidewall 510 of the aperture 506A or 506C but discontinuous with a second sidewall 512 of the aperture 506A or 506C. A second groove 514 of the pattern of grooves 504A or 504C is continuous with the aperture 506A or 506C, respectively, at the second sidewall 512. Referring to FIG. 5A, in one embodiment, the second sidewall 512 is opposite the first sidewall 510, and the second groove 514 is a circumferential groove discontinuous with the aperture 506A at the first sidewall 510. Referring to FIG. 5C, in another embodiment, the second sidewall 512 is orthogonal to the first sidewall 510, and the second groove 514 is a radial groove.

Referring to FIG. 5B, a first groove 516 of the pattern of grooves 504B is a first radial groove continuous with the aperture 506B at a first sidewall 518 of the aperture 506B. A second groove 520 of the plurality of grooves 504B is a second radial groove continuous with the aperture 506B at a second sidewall 522 of the aperture 506B. The first sidewall 518 is opposite the second sidewall 522. In one such embodiment, the first radial groove 516 is staggered from the second radial groove 520, as depicted in FIG. 5B.

Referring to FIGS. 5A, 5B, and 5C, in an embodiment, the arrangement of grooves facilitate the flow of slurry out of apertures 506A, 506B, or 506C, respectively. For example, slurry may flow in the direction of arrows 524, 526, or 528, respectively. Slurry flow may be enhanced by including a ramp feature into one or more of the grooves that directs slurry either into or out of the apertures 506A, 506B, or 506C. For example, in an embodiment, referring to FIG. 5D, an aperture-entering ramp feature 530 or an aperture-exiting ramp feature 532, or both, is included in a groove 550 or 552, respectively. The groove 550 has a ramp feature 530 sloped toward the aperture 506A, 506B, or 506C at a first sidewall of the aperture, while the second groove 552 has a ramp feature 532 sloped toward the aperture 506A, 506B, or 506C at a second sidewall of the aperture.

Figure 6:
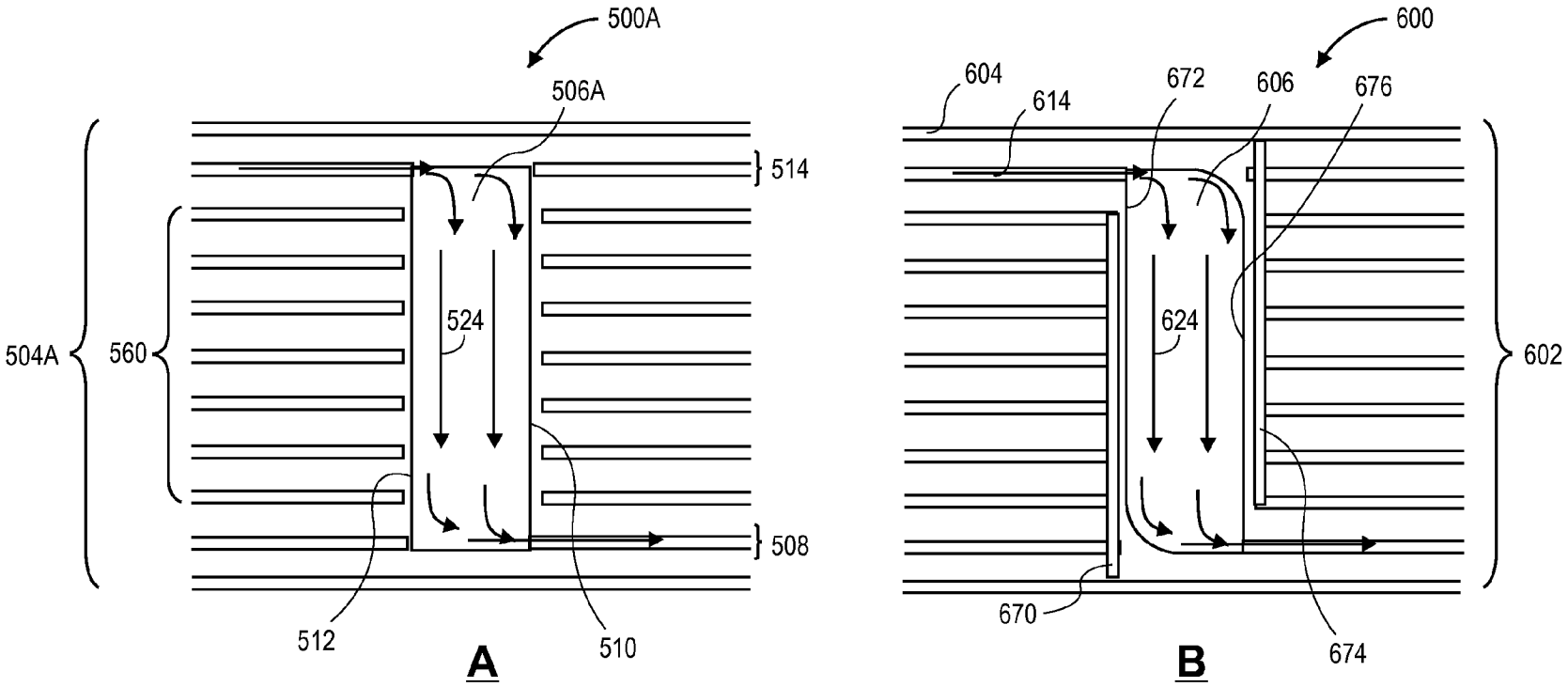
FIG. 6 illustrates top-down plan views of portions of polishing surfaces of polishing pads having grooves blocked or diverted from an aperture, in accordance with an embodiment of the present invention.

In a third such example, FIG. 6 illustrates top-down plan views of portions of polishing surfaces of polishing pads having grooves blocked or diverted from an aperture, in accordance with an embodiment of the present invention. A blocked or diverted flow of one or more of the grooves may be used such that the groove does not drain into the opening of an aperture.

Referring to FIG. 6A, the portion of a polishing pad 500A of FIG. 5A is illustrated again to facilitate description of the concept of blocked grooves. Referring to FIG. 6A, the first groove 508 of the pattern of grooves 504A is a circumferential groove continuous with the aperture 506A at a first sidewall 510 of the aperture 506A, but discontinuous with the second sidewall 512 of the aperture 506A. The second groove 514 of the pattern of grooves 504A is continuous with the aperture 506A at the second sidewall 512 but is discontinuous with the second sidewall 510. A plurality of circumferential grooves 560 that is disposed between the first groove 508 and the second groove 514 is discontinuous with both the first sidewall 510 and the second sidewall 512. In one embodiment, the arrangement of grooves of FIG. 6A is used to control slurry flow 524, such that slurry may essentially only enter the aperture 506A via the second groove 514.

Referring to FIG. 6B, a portion of a polishing pad 600 includes a polishing body having a polishing surface 602 and a back surface (not shown). The polishing surface 602 includes a pattern of grooves 604. An aperture 606 is disposed in the polishing body from the back surface through to the polishing surface 602. The pattern of grooves 604 includes at least one of a diversion groove 670 parallel to a first sidewall 672 of the aperture 606 or a diversion groove 674 parallel to a second sidewall 676 of the aperture 606. In a specific such embodiment, the pattern of grooves 604 includes both the diversion groove 670 parallel to the first sidewall 672 of the aperture 606 and the diversion groove 674 parallel to the second sidewall 676 of the aperture 606, as depicted in FIG. 6B. In one embodiment, the arrangement of grooves of FIG. 6B is used to control slurry flow 624, such that slurry may essentially only enter the aperture 606 via a groove 614.

Figure 7:
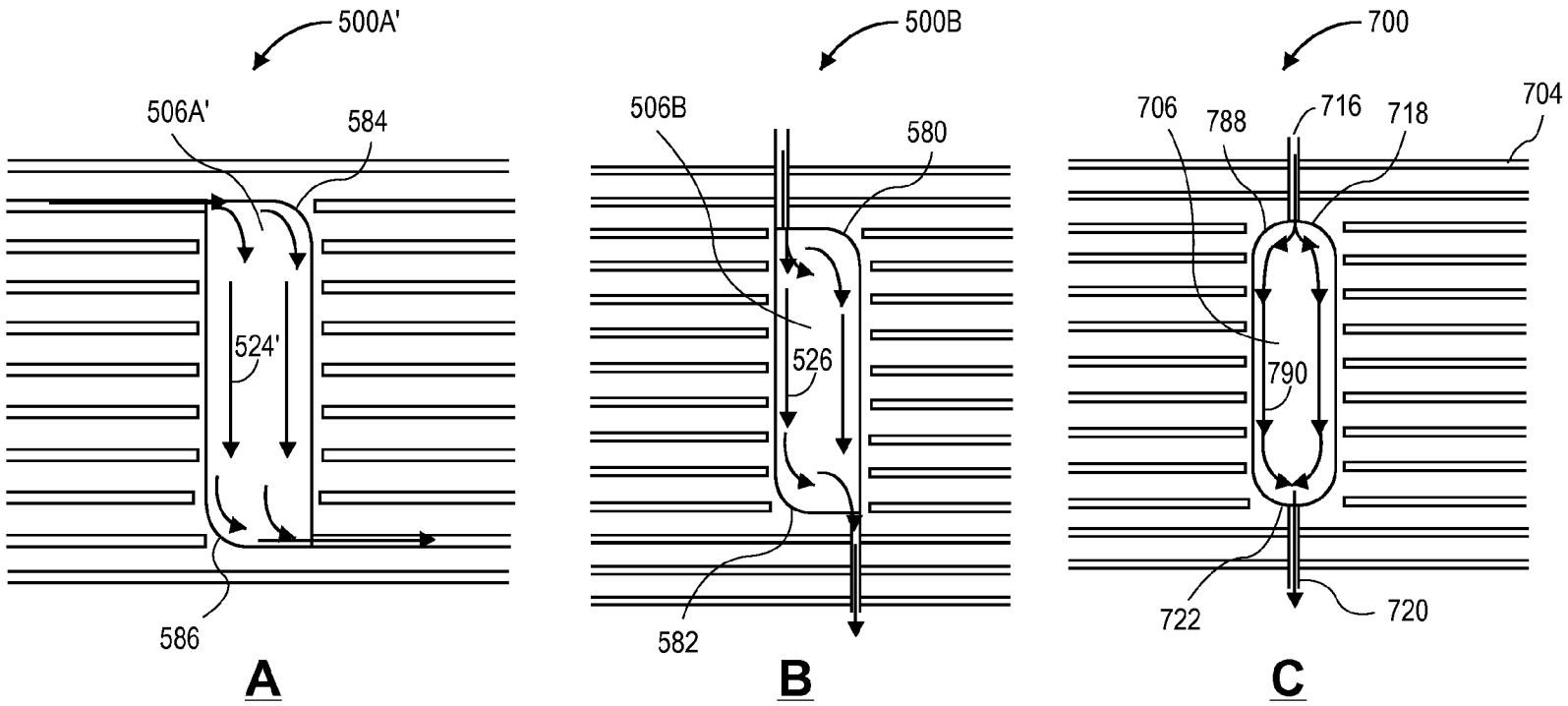
FIG. 7 illustrates top-down plan views of portions of polishing surfaces of polishing pads with an aperture having one or more rounded corners, in accordance with an embodiment of the present invention.

In a fourth such example, FIG. 7 illustrates top-down plan views of portions of polishing surfaces of polishing pads with an aperture having one or more rounded corners, in accordance with an embodiment of the present invention. A rounded shape of some or all of the corners of an opening to an aperture may be used to discourage stagnant spots or eddies where debris may otherwise collect and agglomerate in the aperture during a polishing process.

Referring to FIG. 7B, the portions of a polishing pad 500B of FIG. 5B is illustrated again to facilitate description of the concept of rounded corners in an aperture in a polishing pad. The aperture 506B includes a first rounded corner 580, a second rounded corner 582, or both, as depicted in FIG. 7B. In one embodiment, the rounded corners 580 and 582 are positioned in association with a flow pattern 526 for slurry, in order to hinder possible stagnation in the flow pattern 526. Referring to FIG. 7A, along a similar vein, a portion of a polishing pad 500A', similar to the portion of the polishing pad 500A of FIGS. 5A and 6A, is depicted with rounded corners 584 and 586. In one embodiment, the rounded corners 584 and 586 are positioned in association with a flow pattern 524' for slurry, in order to hinder possible stagnation in the flow pattern 524'.

Referring to FIG. 7C, a first groove 716 of a pattern of grooves 704 of a portion of a polishing pad 700 is a first radial groove continuous with an aperture 706 at a first sidewall 718 of the aperture 706. A second groove 720 of the plurality of grooves 704 is a second radial groove continuous with the aperture 706 at a second sidewall 722 of the aperture 706. The first sidewall 718 is opposite the second sidewall 722. In one such embodiment, the first radial groove 716 is in alignment with the second radial groove 720, as depicted in FIG. 7C. The aperture 706 includes four rounded corners 788, e.g., all corners of aperture 706 are rounded. In one embodiment, the rounded corners 788 are positioned in association with a flow pattern 790 for slurry, in order to hinder possible stagnation in the flow pattern 790.

In an embodiment, polishing pads described herein, such as polishing pad 203 of polishing apparatus 200, are suitable for polishing substrates. The substrate may be one used in the semiconductor manufacturing industry, such as a silicon substrate having device or other layers disposed thereon. However, the substrate may be one such as, but not limited to, a substrates for MEMS devices, reticles, or solar modules. Thus, reference to "a polishing pad for polishing a substrate," as used herein, is intended to encompass these and related possibilities.

Also, polishing pads described herein, such as polishing pad 203 of polishing apparatus 200, may be composed of a homogeneous polishing body of a thermoset polyurethane material. In an embodiment, the homogeneous polishing body is composed of a thermoset, closed cell polyurethane material. In an embodiment, the term "homogeneous" is used to indicate that the composition of a thermoset, closed cell polyurethane material is consistent throughout the entire composition of the polishing body. For example, in an embodiment, the term "homogeneous" excludes polishing pads composed of, e.g., impregnated felt or a composition (composite) of multiple layers of differing material. In an embodiment, the term "thermoset" is used to indicate a polymer material that irreversibly cures, e.g., the precursor to the material changes irreversibly into an infusible, insoluble polymer network by curing. For example, in an embodiment, the term "thermoset" excludes polishing pads composed of, e.g., "thermoplast" materials or "thermoplastics"—those materials composed of a polymer that turns to a liquid when heated and returns to a very glassy state when cooled sufficiently. It is noted that polishing pads made from thermoset materials are typically fabricated from lower molecular weight precursors reacting to form a polymer in a chemical reaction, while pads made from thermoplastic materials are typically fabricated by heating a pre-existing polymer to cause a phase change so that a polishing pad is formed in a physical process. Polyurethane thermoset polymers may be selected for fabricating polishing pads described herein based on their stable thermal and mechanical properties, resistance to the chemical environment, and tendency for wear resistance.

In an embodiment, polishing pads described herein, such as polishing pad 203 of polishing apparatus 200, include a molded homogeneous polishing body. The term "molded" is used to indicate that a homogeneous polishing body is formed in a formation mold, as described in more detail below in association with FIGS. 9A-9F. In an embodiment, the homogeneous polishing body, upon conditioning and/or polishing, has a polishing surface roughness approximately in the range of 1-5 microns root mean square. In one embodiment, the homogeneous polishing body, upon conditioning and/or polishing, has a polishing surface roughness of approximately 2.35 microns root mean square. In an embodiment, the homogeneous polishing body has a storage modulus at 25 degrees Celsius approximately in the range of 30-120 megaPascals (MPa). In another embodiment, the homogeneous polishing body has a storage modulus at 25 degrees Celsius approximately less than 30 megaPascals (MPa). In an embodiment, as described in association with FIGS. 9A-9F, a polishing pad is composed of a molded polishing body, and an aperture included therein is formed during the forming of the molded polishing body. In an alternative embodiment, however, the aperture is formed in a polishing pad subsequent to forming the body of the polishing pad.

In an embodiment, polishing pads described herein, such as polishing pad 203 of polishing apparatus 200, include a polishing body having a plurality of closed cell pores therein. In one embodiment, the plurality of closed cell pores is a plurality of porogens. For example, the term "porogen" may be used to indicate micro- or nano-scale spherical or somewhat spherical particles with "hollow" centers. The hollow centers are not filled with solid material, but may rather include a gaseous or liquid core. In one embodiment, the plurality of closed cell pores is composed of pre-expanded and gas-filled EXPANCEL™ distributed throughout (e.g., as an additional component in) a homogeneous polishing body of the polishing pad. In a specific embodiment, the EXPANCEL™ is filled with pentane. In an embodiment, each of the plurality of closed cell pores has a diameter approximately in the range of 10-100 microns. In an embodiment, the plurality of closed cell pores includes pores that are discrete from one another. This is in contrast to open cell pores which may be connected to one another through tunnels, such as the case for the pores in a common sponge. In one embodiment, each of the closed cell pores includes a physical shell, such as a shell of a porogen, as described above. In another embodiment, however, each of the closed cell pores does not include a physical shell. In an embodiment, the plurality of closed cell pores is distributed essentially evenly throughout a thermoset polyurethane material of a homogeneous polishing body.

In an embodiment, the homogeneous polishing body is opaque. In one embodiment, the term "opaque" is used to indicate a material that allows approximately 10% or less visible light to pass. In one embodiment, the homogeneous polishing body is opaque in most part, or due entirely to, the inclusion of a particle filler such as an opacifying lubricant throughout (e.g., as an additional component in) the homogeneous thermoset, closed cell polyurethane material of the homogeneous polishing body. In a specific embodiment, the particle filler is a material such as, but not limited to: boron nitride, cerium fluoride, graphite, graphite fluoride, molybdenum sulfide, niobium sulfide, talc, tantalum sulfide, tungsten disulfide, or Teflon.

The sizing of the homogeneous polishing body may be varied according to application. Nonetheless, certain parameters may be used to make polishing pads including such a homogeneous polishing body compatible with conventional processing equipment or even with conventional chemical mechanical processing operations. For example, in accordance with an embodiment of the present invention, the homogeneous polishing body has a thickness approximately in the range of 0.075 inches to 0.130 inches, e.g., approximately in the range of 1.9-3.3 millimeters. In one embodiment, the homogeneous polishing body has a diameter approximately in the range of 20 inches to 30.3 inches, e.g., approximately in the range of 50-77 centimeters, and possibly approximately in the range of 10 inches to 42 inches, e.g., approximately in the range of 25-107 centimeters. In one embodiment, the homogeneous polishing body has a pore density approximately in the range of 6%-36% total void volume, and possibly approximately in the range of 15%-35% total void volume. In one embodiment, the homogeneous polishing has a porosity of the closed cell type, as described above, due to inclusion of a plurality of pores. In one embodiment, the homogeneous polishing body has a compressibility of approximately 2.5%. In one embodiment, the homogeneous polishing body has a density approximately in the range of 0.70-1.05 grams per cubic centimeter.

In another embodiment, a polishing pad having a polishing surface with an aperture further includes a secondary detection region for use with, e.g., an eddy current detection system. For example, FIGS. 8A and 8B illustrate a top-down plan view and a cross-sectional view, respectively, of a polishing pad with a polishing surface having an aperture and a back surface having a secondary detection region, in accordance with an embodiment of the present invention.

Figure 8A:
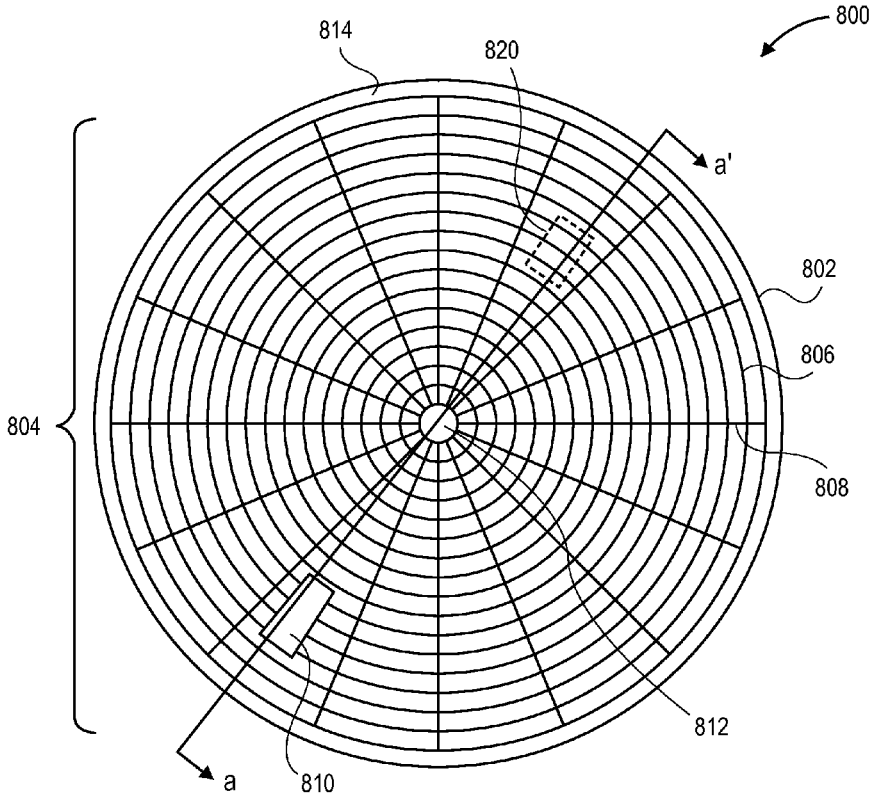
FIG. 8A illustrates a top-down plan view of a polishing surface of a polishing pad, the polishing surface having an aperture and a back surface secondary detection region, in accordance with an embodiment of the present invention.

Referring to FIG. 8A, a polishing pad 800 is provided for polishing a substrate. The polishing pad 800 includes a polishing body having a polishing surface 802. The polishing surface 802 has a pattern of grooves with a polishing region 804. The pattern of grooves includes a plurality of circumferential grooves 806 intersecting with a plurality of radial grooves 808. The polishing region 804 of the pattern of grooves includes an aperture 810 that extends through the entire polishing pad 800. That is, polishing surface 802 includes an aperture 810 included in a region other than in a non-polishing region, e.g., other than in button 812 or outermost region 814. Although not depicted in FIG. 8A, polishing pad 800 also has a back surface. The back surface may have disposed therein a secondary detection region 820, depicted by dashed lines in FIG. 8A since the secondary detection region 820 would otherwise not be visible from the view presented in FIG. 8A.

Figure 8B:
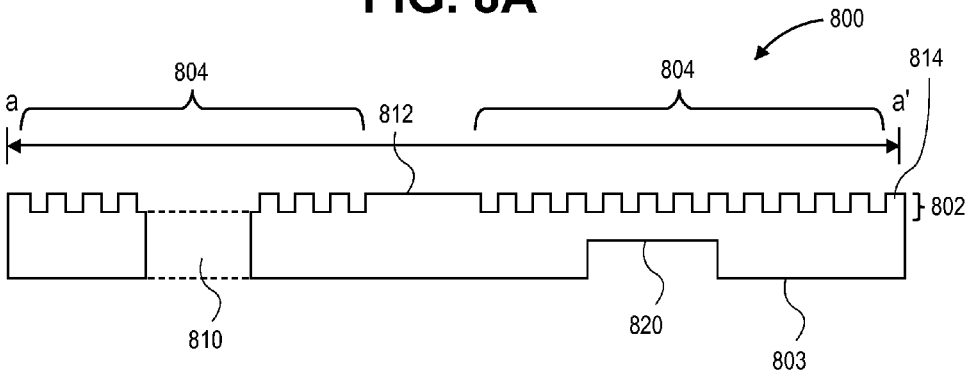
FIG. 8B illustrates a cross-sectional view of a polishing pad with a polishing surface having an aperture and a back surface having a secondary detection region, in accordance with an embodiment of the present invention.

Referring to FIG. 8B, a cross-section of polishing pad 800 taken along the a-a' axis of FIG. 8A is shown. From the viewpoint of FIG. 8B, the polishing surface 802, a back surface 803, the polishing region 804, the button 812, the outer-most region 814, the secondary detection region 820, and the aperture 810 can be seen. In an embodiment, the aperture 810 provides information as to the location of the secondary detection region 820 which is not visible from the view presented in FIG. 8A. Examples of suitable secondary detection regions, such as eddy current detection regions, are described in U.S. patent application Ser. No. 12/895,465 filed on Sep. 30, 2010, assigned to NexPlanar Corporation.

In an aspect of the present invention, polishing pads having apertures therein may be fabricated in a molding process. For example, FIGS. 9A-9F illustrate cross-sectional views of operations used in the fabrication of a polishing pad with an aperture, in accordance with an embodiment of the present invention.

Figure 9A:
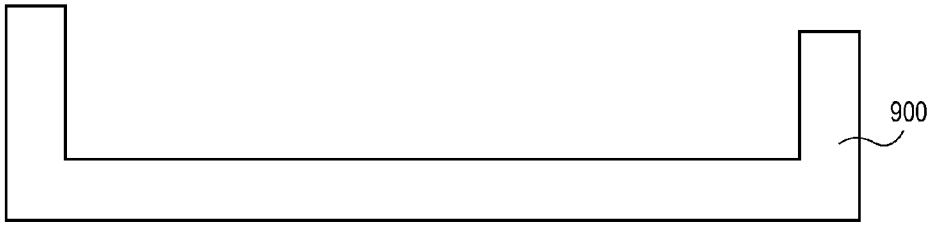
FIGS. 9A-9F illustrate cross-sectional views of operations used in the fabrication of a polishing pad with an aperture, in accordance with an embodiment of the present invention.
Figure 9B:
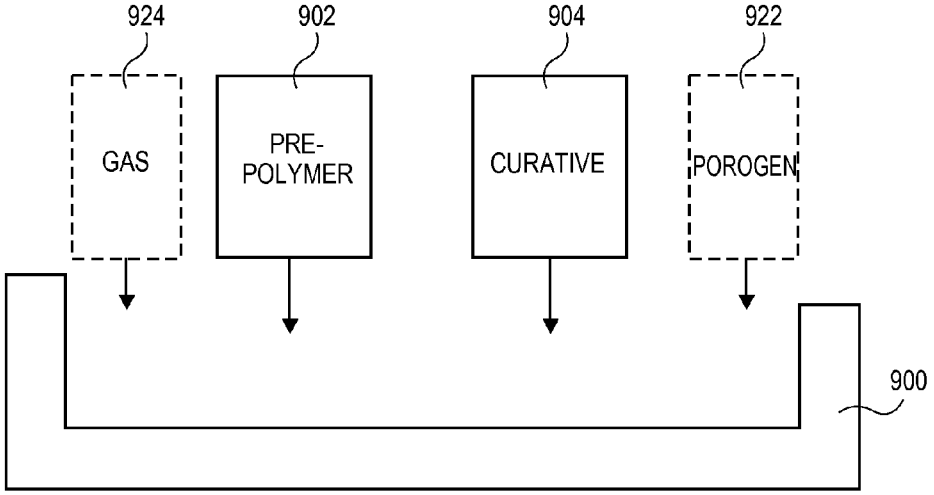
Figure 9C:
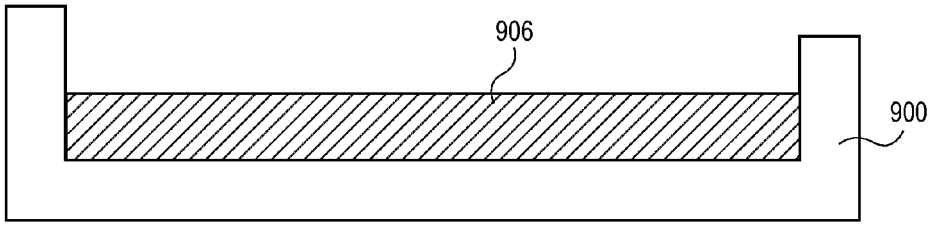

Referring to FIG. 9A, a formation mold 900 is provided. Referring to FIG. 9B, a set of polymerizable materials such as a pre-polymer 902 and a curative 904 are mixed to form a mixture 906 in the formation mold 900, as depicted in FIG. 9C. In an embodiment, mixing the pre-polymer 902 and the curative 904 includes mixing an isocyanate and an aromatic diamine compound, respectively. In one embodiment, the mixing further includes adding a particle filler such as an opacifying lubricant to the pre-polymer 902 and the curative 904 to ultimately provide an opaque molded homogeneous polishing body. In a specific embodiment, the opacifying lubricant is a material such as, but not limited to: boron nitride, cerium fluoride, graphite, graphite fluoride, molybdenum sulfide, niobium sulfide, talc, tantalum sulfide, tungsten disulfide, or Teflon.

In an embodiment, the polishing pad precursor mixture 906 is used to ultimately form a molded homogeneous polishing body composed of a thermoset, closed cell polyurethane material. In one embodiment, the polishing pad precursor mixture 906 is used to ultimately form a hard pad and only a single type of curative is used. In another embodiment, the polishing pad precursor mixture 906 is used to ultimately form a soft pad and a combination of a primary and a secondary curative is used. For example, in a specific embodiment, the pre-polymer includes a polyurethane precursor, the primary curative includes an aromatic diamine compound, and the secondary curative includes a compound having an ether linkage. In a particular embodiment, the polyurethane precursor is an isocyanate, the primary curative is an aromatic diamine, and the secondary curative is a curative such as, but not limited to, polytetramethylene glycol, amino-functionalized glycol, or amino-functionalized polyoxypropylene. In an embodiment, the pre-polymer, a primary curative, and a secondary curative have an approximate molar ratio of 100 parts pre-polymer, 85 parts primary curative, and 15 parts secondary curative. It is to be understood that variations of the ratio may be used to provide polishing pads with varying hardness values, or based on the specific nature of the pre-polymer and the first and second curatives.

Figure 9D:
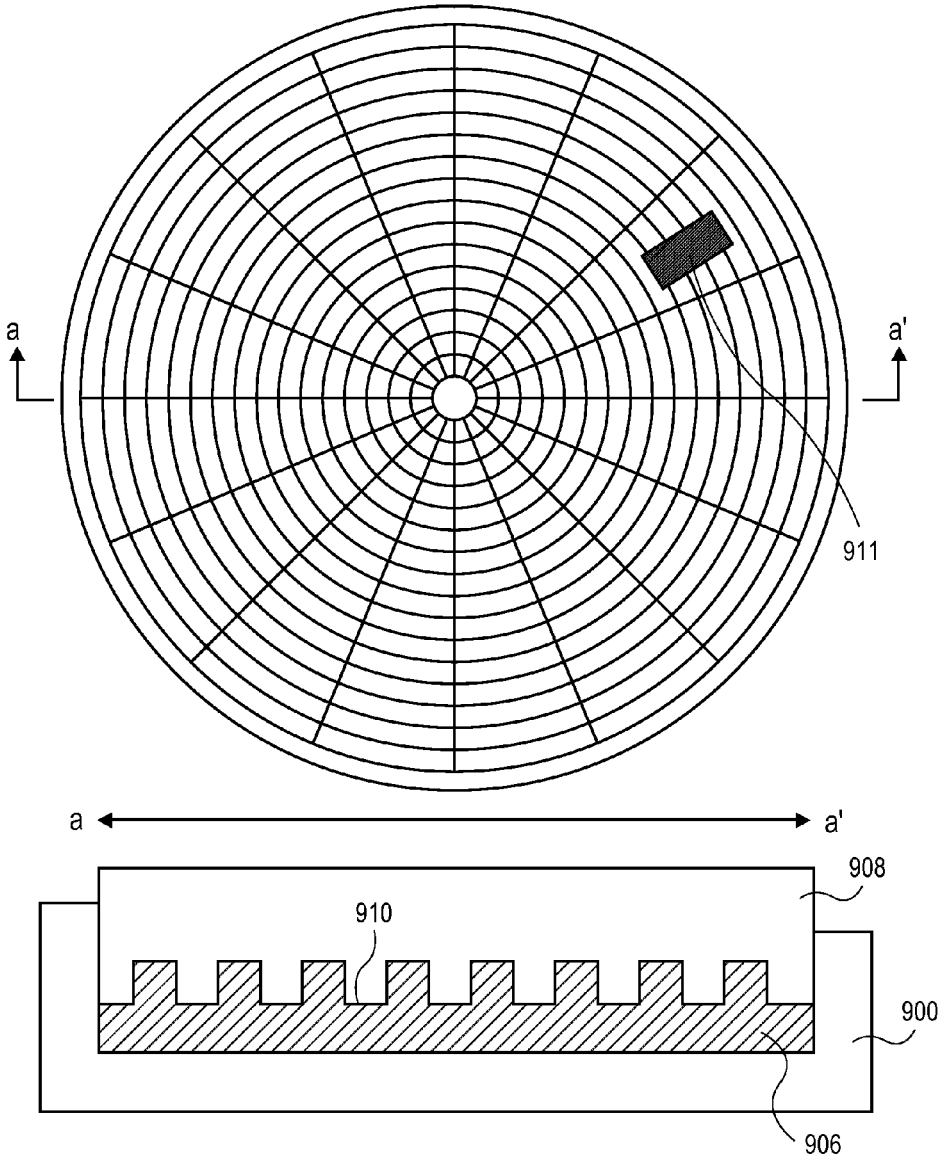

Referring to FIG. 9D, a lid 908 of the formation mold 900 and the mixture 906 are moved together, e.g., the lid 908 is moved into the mixture 906. A top-down plan view of lid 908 is shown on top, while a cross-section along the a-a' axis is shown below in FIG. 9D. In an embodiment, the lid 908 has disposed thereon a pattern of protrusions 910 and an aperture forming feature 911. The pattern of protrusions 910 is used to stamp a pattern of grooves into a polishing surface of a polishing pad formed in formation mold 900.

In an embodiment, the aperture forming feature 911 is also a protrusion. For example, in one embodiment, the aperture forming feature 911 is an aperture protrusion having a height greater than the height of the protrusions of the pattern of protrusions 910. In a specific embodiment, the aperture protrusion 911 has a height at least triple the height of the protrusions of the pattern of protrusions 910.

It is to be understood that embodiments described herein that describe lowering the lid 908 of a formation mold 900 need only achieve a bringing together of the lid 908 and a base of the formation mold 900. That is, in some embodiments, a base of a formation mold 900 is raised toward a lid 908 of a formation mold, while in other embodiments a lid 908 of a formation mold 900 is lowered toward a base of the formation mold 900 at the same time as the base is raised toward the lid 908.

Figure 9E:
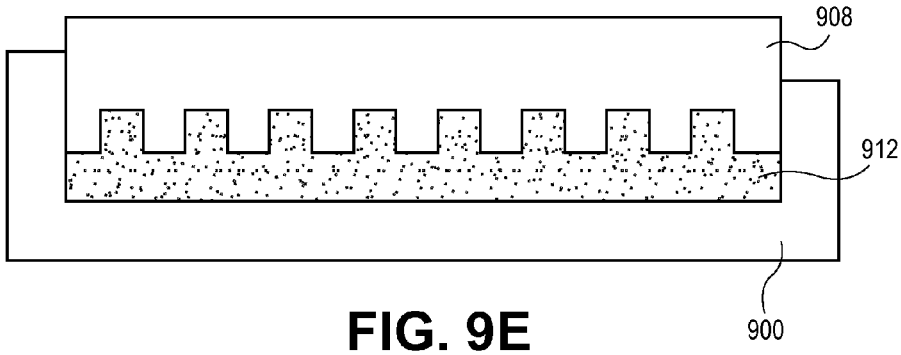

Referring to FIG. 9E, the mixture 906 is cured to provide a molded homogeneous polishing body 912 in the formation mold 900. The mixture 906 is heated under pressure (e.g., with the lid 908 in place) to provide the molded homogeneous polishing body 912. In an embodiment, heating in the formation mold 900 includes at least partially curing in the presence of lid 908, which encloses mixture 906 in formation mold 900, at a temperature approximately in the range of 200-260 degrees Fahrenheit and a pressure approximately in the range of 2-12 pounds per square inch.

Figure 9F:
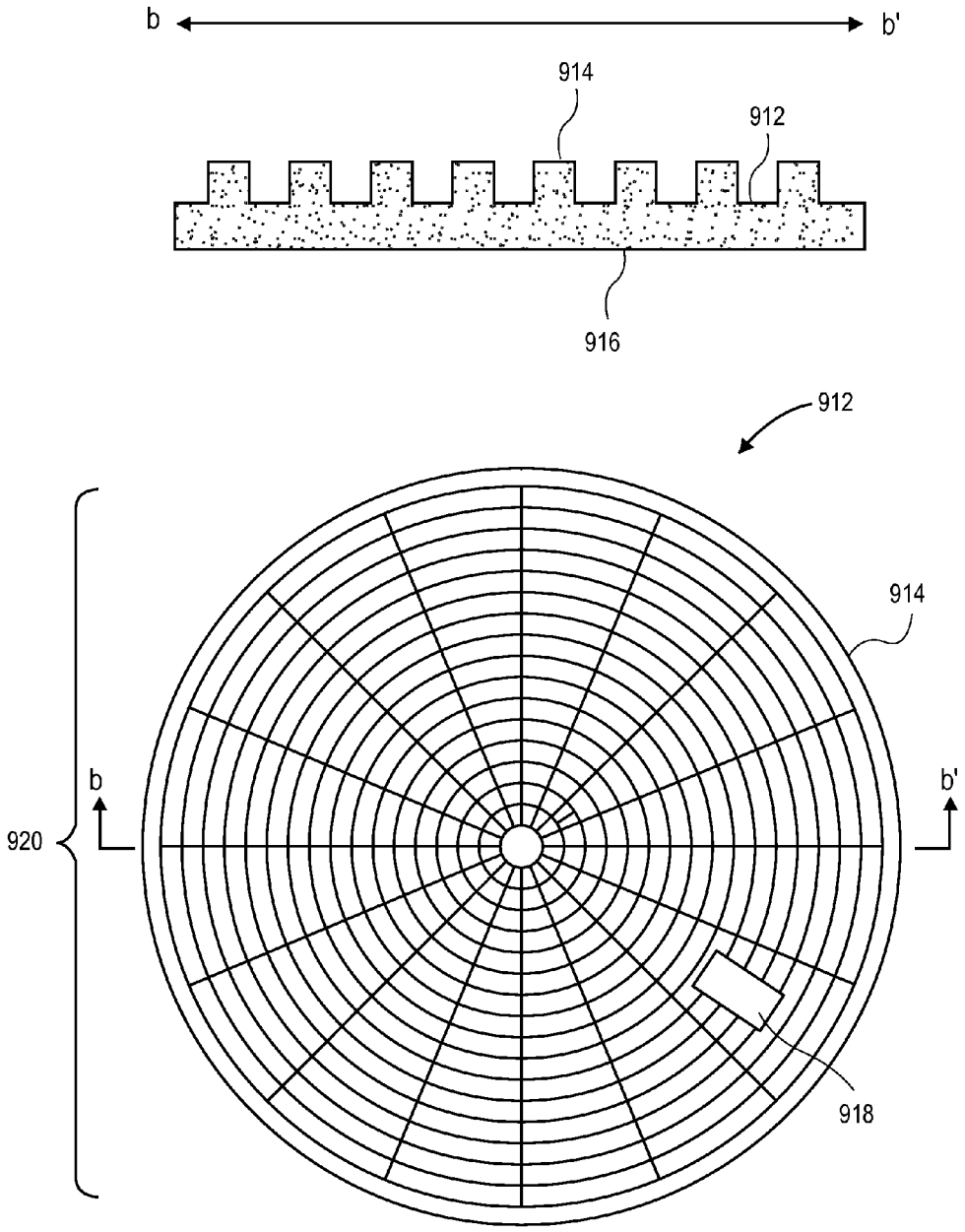

Referring to FIG. 9F, a polishing pad (or polishing pad precursor, if further curing is required) is separated from lid 908 and removed from formation mold 900 to provide the discrete molded homogeneous polishing body 912. A top-down plan view of molded homogeneous polishing body 912 is shown below, while a cross-section along the b-b' axis is shown above in FIG. 9F. It is noted that further curing through heating may be desirable and may be performed by placing the polishing pad in an oven and heating. Thus, in one embodiment, curing the mixture 906 includes first partially curing in the formation mold 900 and then further curing in an oven. Either way, a polishing pad is ultimately provided, wherein a molded homogeneous polishing body 912 of the polishing pad has a polishing surface 914 and a back surface 916. In an embodiment, the molded homogeneous polishing body 912 is composed of a thermoset polyurethane material and a plurality of closed cell pores disposed in the thermoset polyurethane material.

The molded homogeneous polishing body 912 includes a polishing surface 914 having disposed therein a pattern of grooves 920 corresponding to the pattern of protrusions 910 of the lid 908. The pattern of grooves 920 may be a pattern of grooves as described above, e.g., with respect to FIGS. 1-8. Additionally, the molded homogeneous polishing body 912 includes in its polishing surface 914 an opening defining an aperture region 918, corresponding to the aperture forming feature 911 of the lid 908.

In an embodiment, the opening defining the aperture region 918 is made to ultimately extend through the entire polishing body 912. The opening defining the aperture region 918 may be formed to extend through the polishing body 912 during molding or during a subsequent removal of a portion of the material of polishing body 912. For example, in one embodiment, forming the molded homogeneous polishing body 912 includes forming an aperture disposed in molded homogeneous polishing body 912 from the back surface 916 through to the polishing surface 914 at the aperture region 918 at the time of molding. In another embodiment, however, a portion of the homogeneous polishing body 912 is removed from the back surface 916 to form a polishing pad having a second back surface and to form an aperture disposed in molded homogeneous polishing body 912 from the second back surface through to the polishing surface 914 at the aperture region 918. That is, the aperture is formed by removing a portion of the molded material from the backside. In a specific such embodiment, the portion of the molded material is removed from the backside by cutting or by grinding.

In an embodiment, forming the molded homogeneous polishing body 912 includes forming the aperture region 918 to include a sidewall having a ramp feature with a slope to provide a narrowest region of the aperture region 918 proximate to the back surface 916 of the molded homogeneous polishing body 912 and a widest region of the aperture region 918 at the polishing surface 914 of the molded homogeneous polishing body 912, as described above at least in association with FIGS. 3 and 4. In another embodiment, forming the molded homogeneous polishing body 912 includes forming the polishing surface 914 to include a first groove of the pattern of grooves that is a circumferential groove continuous with the aperture region 918 at a first sidewall of the aperture region 918 but discontinuous with a second sidewall of the aperture region 918, and a second groove of the pattern of grooves that is continuous with the aperture region 918 at the second sidewall, as described above at least in association with FIG. 5A. In another embodiment, forming the molded homogeneous polishing body 912 includes forming the polishing surface 914 to include a first groove of the pattern of grooves that is a first radial groove continuous with the aperture region 918 at a first sidewall of the aperture region 918, and a second groove of the plurality of grooves that is a second radial groove continuous with the aperture region 918 at a second sidewall of the aperture region 918, wherein the first sidewall is opposite the second sidewall, as described above at least in association with FIG. 5B.

In an embodiment, referring again to FIG. 9B, the mixing further includes adding a plurality of porogens 922 to the pre-polymer 902 and the curative 904 to provide closed cell pores in the ultimately formed polishing pad. Thus, in one embodiment, each closed cell pore has a physical shell. In another embodiment, referring again to FIG. 9B, the mixing further includes injecting a gas 924 into to the pre-polymer 902 and the curative 904, or into a product formed there from, to provide closed cell pores in the ultimately formed polishing pad. Thus, in one embodiment, each closed cell pore has no physical shell. In a combination embodiment, the mixing further includes adding a plurality of porogens 922 to the pre-polymer 902 and the curative 904 to provide a first portion of closed cell pores each having a physical shell, and further injecting a gas 924 into the pre-polymer 902 and the curative 904, or into a product formed there from, to provide a second portion of closed cell pores each having no physical shell. In yet another embodiment, the pre-polymer 902 is an isocyanate and the mixing further includes adding water ($H_2O$) to the pre-polymer 902 and the curative 904 to provide closed cell pores each having no physical shell.

Thus, groove patterns contemplated in embodiments of the present invention may be formed in-situ. Furthermore, apertures may also be formed simultaneously in the molding fabrication process. For example, as described above, a compression-molding process may be used to form polishing pads with a grooved polishing surface having an aperture therein. By using a molding process, highly uniform groove dimensions within-pad may be achieved. Furthermore, extremely reproducible groove dimensions along with very smooth, clean groove surfaces may be produced. Other advantages may include reduced defects and micro-scratches and a greater usable groove depth.

Also, since the fabricated aperture is formed during the molding, the positioning of the resulting pad during formation of a pad in a mold can be determined after removal of the pad from the mold. That is, such an aperture can provide traceability back to the molding process. Thus, in one embodiment, the polishing body of a polishing pad is a molded polishing body, and an aperture included therein indicates a location of a region in a mold used for forming the molded polishing body.

Individual grooves of the groove patterns described herein, including grooves at or near a location of an aperture in a polishing pad, may be from about 4 to about 100 mils deep at any given point on each groove. In some embodiments, the grooves are about 10 to about 50 mils deep at any given point on each groove. The grooves may be of uniform depth, variable depth, or any combinations thereof. In some embodiments, the grooves are all of uniform depth. For example, the grooves of a groove pattern may all have the same depth. In some embodiments, some of the grooves of a groove pattern may have a certain uniform depth while other grooves of the same pattern may have a different uniform depth. For example, groove depth may increase with increasing distance from the center of the polishing pad. In some embodiments, however, groove depth decreases with increasing distance from the center of the polishing pad. In some embodiments, grooves of uniform depth alternate with grooves of variable depth.

Individual grooves of the groove patterns described herein, including grooves at or near a location of an aperture in a polishing pad, may be from about 2 to about 100 mils wide at any given point on each groove. In some embodiments, the grooves are about 15 to about 50 mils wide at any given point on each groove. The grooves may be of uniform width, variable width, or any combinations thereof. In some embodiments, the grooves of a concentric polygon pattern are all of uniform width. In some embodiments, however, some of the grooves of a concentric polygon pattern have a certain uniform width, while other grooves of the same pattern have a different uniform width. In some embodiments, groove width increases with increasing distance from the center of the polishing pad. In some embodiments, groove width decreases with increasing distance from the center of the polishing pad. In some embodiments, grooves of uniform width alternate with grooves of variable width.

In accordance with the previously described depth and width dimensions, individual grooves of the groove patterns described herein, including grooves at or near a location of an aperture in a polishing pad, may be of uniform volume, variable volume, or any combinations thereof. In some embodiments, the grooves are all of uniform volume. In some embodiments, however, groove volume increases with increasing distance from the center of the polishing pad. In some other embodiments, groove volume decreases with increasing distance from the center of the polishing pad. In some embodiments, grooves of uniform volume alternate with grooves of variable volume.

Grooves of the groove patterns described herein may have a pitch from about 30 to about 1000 mils. In some embodiments, the grooves have a pitch of about 125 mils. For a circular polishing pad, groove pitch is measured along the radius of the circular polishing pad. In CMP belts, groove pitch is measured from the center of the CMP belt to an edge of the CMP belt. The grooves may be of uniform pitch, variable pitch, or in any combinations thereof. In some embodiments, the grooves are all of uniform pitch. In some embodiments, however, groove pitch increases with increasing distance from the center of the polishing pad. In some other embodiments, groove pitch decreases with increasing distance from the center of the polishing pad. In some embodiments, the pitch of the grooves in one sector varies with increasing distance from the center of the polishing pad while the pitch of the grooves in an adjacent sector remains uniform. In some embodiments, the pitch of the grooves in one sector increases with increasing distance from the center of the polishing pad while the pitch of the grooves in an adjacent sector increases at a different rate. In some embodiments, the pitch of the grooves in one sector increases with increasing distance from the center of the polishing pad while the pitch of the grooves in an adjacent sector decreases with increasing distance from the center of the polishing pad. In some embodiments, grooves of uniform pitch alternate with grooves of variable pitch. In some embodiments, sectors of grooves of uniform pitch alternate with sectors of grooves of variable pitch.

Polishing pads described herein may be suitable for use with a variety of chemical mechanical polishing apparatuses. As an example, FIG. 10 illustrates an isometric side-on view of a polishing apparatus compatible with a polishing pad having an aperture, in accordance with an embodiment of the present invention.

Figure 10:
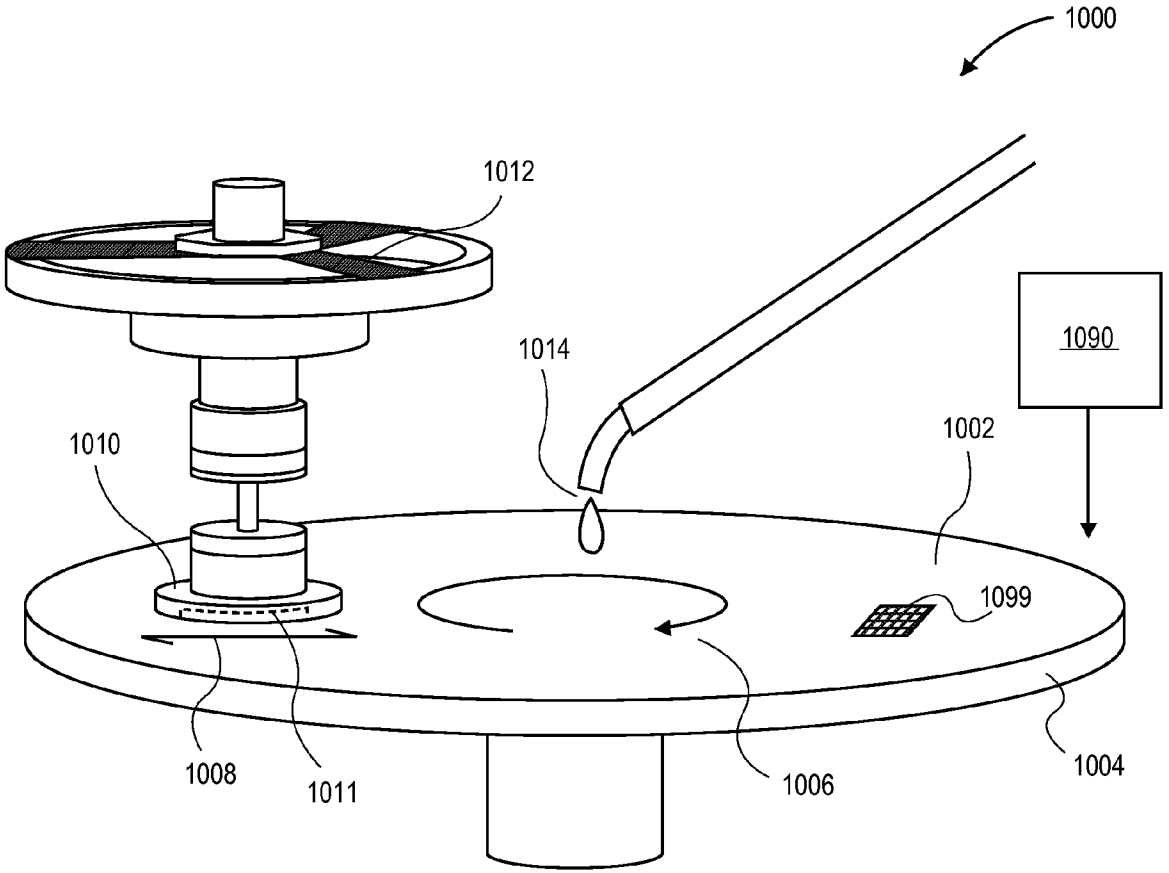
FIG. 10 illustrates an isometric side-on view of a polishing apparatus compatible with a polishing pad having an aperture, in accordance with an embodiment of the present invention.

Referring to FIG. 10, a polishing apparatus 1000 includes a platen 1004. The top surface 1002 of platen 1004 may be used to support a polishing pad with an aperture disposed there through. Platen 1004 may be configured to provide spindle rotation 1006 and slider oscillation 1008. A sample carrier 1010 is used to hold, e.g., a semiconductor wafer 1011 in place during polishing of the semiconductor wafer with a polishing pad. Sample carrier 1010 is further supported by a suspension mechanism 1012. A slurry feed 1014 is included for providing slurry to a surface of a polishing pad prior to and during polishing of the semiconductor wafer. A conditioning unit 1090 may also be included and, in one embodiment, includes a diamond tip for conditioning a polishing pad. In accordance with an embodiment of the present invention, an aperture of a polishing pad, such as an aperture described in association with FIG. 2-8, is positioned for alignment with an optical detection device 1099 disposed on or within the platen 1004 of polishing apparatus 1000, as depicted in FIG. 10. In an embodiment, an aperture of a polishing pad is sized to accommodate the optical detection device 1099 without being so big as to significantly impact polishing performance of the polishing pad. In an embodiment, an adhesive sheet is used to couple a polishing pad having an aperture on the platen 1004.

As described above, in an embodiment, modern slurries are essentially transparent and will not attenuate or scatter a detection beam as early-generation slurries may otherwise have. Constant flow of slurry across an aperture opening may keep the opening free of debris. In one embodiment, a molding process is suitable for creating the opening during molding, so no extra manufacturing operations are needed. For windowless design features, in an embodiment, the purpose of each feature is to enable constant flushing of the opening with slurry during use. Features may be used individually or in combination. As described above, and in accordance with one or more embodiments of the present invention, one such feature may be a wedge or ramp shape of one or more edges of the opening. Another such feature may include one or more grooves connected with the opening. Radial grooves, circumferential grooves, or a combination thereof may be connected or continuous with the opening. The groove depth may be equal to the opening depth where they connect, with the groove floor ramping up to normal groove depth. Blocked or diverted flow of some grooves may be used so that they do not drain into the opening. A rounded shape of some or all of the corners of the opening may also be used.

In reference to polishing apparatus 1000 and one or more polishing pads described in association with FIGS. 2-8, a method of polishing a substrate includes disposing a polishing pad above a platen of a chemical mechanical polishing apparatus. The polishing pad has a polishing surface, a back surface, and an aperture disposed in the polishing pad from the back surface through to the polishing surface. The polishing surface includes a pattern of grooves. A chemical mechanical polishing slurry is dispensed on the polishing surface of the polishing pad. A substrate is polished with the chemical mechanical polishing slurry at the polishing surface of the polishing pad. The polishing of the substrate is monitored, through the aperture, with an optical monitoring device coupled with the platen.

In one embodiment, disposing the polishing pad above the platen includes adhering the polishing pad to the platen with an adhesive sheet. In a specific such embodiment, adhering the polishing pad to the platen with the adhesive sheet is for protecting a quartz laser site of the optical monitoring device. In another embodiment, polishing the substrate with the chemical mechanical polishing slurry includes flushing the chemical mechanical polishing slurry from the aperture. In another embodiment, polishing the substrate with the chemical mechanical polishing slurry includes dispensing a slurry of sufficient transparency for monitoring the polishing of the substrate with the optical monitoring device. In a specific such embodiment, dispensing the slurry of sufficient transparency includes dispensing a slurry having greater than approximately 80% transmission of a wavelength of light emitted from the optical monitoring device. In another specific such embodiment, dispensing the slurry of sufficient transparency includes dispensing a slurry having less than approximately 1% of opaque components.

Thus, polishing pads with apertures have been disclosed. In accordance with an embodiment of the present invention, a polishing apparatus for polishing a substrate includes a polishing pad having a polishing surface and a back surface. The polishing surface includes a pattern of grooves. An aperture is disposed in the polishing pad from the back surface through to the polishing surface. An adhesive sheet is disposed on the back surface of the polishing pad but not in the aperture. The adhesive sheet provides an impermeable seal for the aperture at the back surface of the polishing pad. In one embodiment, the aperture has a sidewall having a ramp feature with a slope to provide a narrowest region of the aperture at the back surface of the polishing pad and a widest region of the aperture at the polishing surface of the polishing pad. In one embodiment, a first groove of the pattern of grooves is a circumferential groove continuous with the aperture at a first sidewall of the aperture but discontinuous with a second sidewall of the aperture, and a second groove of the pattern of grooves is continuous with the aperture at the second sidewall. In one embodiment, a first groove of the pattern of grooves is a first radial groove continuous with the aperture at a first sidewall of the aperture, a second groove of the plurality of grooves is a second radial groove continuous with the aperture at a second sidewall of the aperture, and the first sidewall is opposite the second sidewall.

What is claimed is:

1. A polishing apparatus for polishing a substrate, the polishing apparatus comprising:

a polishing pad having a polishing surface and a back surface, the polishing surface comprising a pattern of grooves;

an aperture disposed in the polishing pad from the back surface through to the polishing surface, wherein a first groove of the pattern of grooves is a circumferential groove continuous with the aperture at a first sidewall of the aperture but discontinuous with a second sidewall of the aperture, and wherein a second groove of the pattern of grooves is continuous with the aperture at the second sidewall; and an adhesive sheet disposed on the back surface of the polishing pad but not in the aperture, the adhesive sheet providing an impermeable seal for the aperture at the back surface of the polishing pad.

2. The polishing apparatus of claim 1, wherein the adhesive sheet comprises a layer of acrylic glue disposed on the back surface of the polishing pad and a layer of polyethylene terephthalate (PET) disposed on the layer of acrylic glue.

3. The polishing apparatus of claim 2, wherein the adhesive sheet further comprises a layer of rubber glue disposed on the layer of PET, opposite the layer of acrylic glue.

4. The polishing pad of claim 3, wherein the layer of rubber glue is for adhering the polishing pad to a platen of a chemical mechanical polishing tool.

5. The polishing apparatus of claim 1, wherein the second sidewall is opposite the first sidewall, and the second groove is a circumferential groove discontinuous with the aperture at the first sidewall.

6. The polishing apparatus of claim 5, wherein the pattern of grooves comprises at least one of a diversion groove parallel to the first sidewall of the aperture or a diversion groove parallel to the second sidewall of the aperture.

7. The polishing apparatus of claim 6, wherein the pattern of grooves comprises a diversion groove parallel to the first sidewall of the aperture and a diversion groove parallel to the second sidewall of the aperture.

8. The polishing apparatus of claim 1, wherein the second sidewall is orthogonal to the first sidewall, and the second groove is a radial groove.

9. The polishing apparatus of claim 1, wherein the first groove has a ramp feature sloped toward the aperture at the first sidewall, and the second groove has a ramp feature sloped toward the aperture at the second sidewall.

10. The polishing apparatus of claim 1, wherein the aperture comprises one or more rounded corners.

11. A polishing pad for polishing a substrate, the polishing pad comprising:

a polishing body having a polishing surface and a back surface, the polishing surface comprising a pattern of grooves; and an aperture disposed in the polishing body from the back surface through to the polishing surface, wherein a first groove of the pattern of grooves is a circumferential groove continuous with the aperture at a first sidewall of the aperture but discontinuous with a second sidewall of the aperture, and wherein a second groove of the pattern of grooves is continuous with the aperture at the second sidewall.

12. The polishing pad of claim 11, wherein the second sidewall is opposite the first sidewall, and the second groove is a circumferential groove discontinuous with the aperture at the first sidewall.

13. The polishing pad of claim 12, wherein the pattern of grooves comprises at least one of a diversion groove parallel to the first sidewall of the aperture or a diversion groove parallel to the second sidewall of the aperture.

14. The polishing pad of claim 13, wherein the pattern of grooves comprises a diversion groove parallel to the first sidewall of the aperture and a diversion groove parallel to the second sidewall of the aperture.

15. The polishing pad of claim 11, wherein the second sidewall is orthogonal to the first sidewall, and the second groove is a radial groove.

16. The polishing pad of claim 11, wherein the first groove has a ramp feature sloped toward the aperture at the first sidewall, and the second groove has a ramp feature sloped toward the aperture at the second sidewall.

17. The polishing pad of claim 11, wherein the aperture comprises one or more rounded corners.

* * * * *